US006212772B1

(12) United States Patent
Whitmyre et al.

(10) Patent No.: US 6,212,772 B1
(45) Date of Patent: Apr. 10, 2001

(54) PRODUCTION OF A CARIBBEAN STEEL PAN

(76) Inventors: George Whitmyre, 24 Lochcarron Dr., Elkton, MD (US) 21921; Harvey J. Price, 2708 Baynard Blvd., Wilmington, DE (US) 19802

( * ) Notice: Subject to any disclaimer, the term of this patent is extended or adjusted under 35 U.S.C. 154(b) by 0 days.

(21) Appl. No.: 09/338,058

(22) Filed: Jun. 23, 1999

(51) Int. Cl.[7] ..... G10D 13/02
(52) U.S. Cl. ..... 29/896.22; 84/411 R
(58) Field of Search ..... 29/896.22; 84/411 R, 84/416, 418, 419, 438; 700/98, 163, 197

(56) References Cited

U.S. PATENT DOCUMENTS 5,330,848 * 7/1994 Kluczynski et al. ..... 29/896.22

OTHER PUBLICATIONS

Kronman, Uif, "Steel Pan Tuning" Published by Musikmuseet, Copyright 1991, Jan. 1992.*

* cited by examiner

*Primary Examiner*—P. W. Echols
(74) *Attorney, Agent, or Firm*—Huntley & Associates

(57) ABSTRACT

Process for the formation of a Caribbean steel pan using a hydroforming press and the resulting pans.

13 Claims, 1 Drawing Sheet

PRODUCTION OF A CARIBBEAN STEEL PAN

BACKGROUND OF THE INVENTION

This invention relates to the Caribbean (Calypso) steel pan, a musical instrument typically created from a metal barrel or drum. Traditional pan production begins with a half barrel or drum, wherein the top or bottom flat panel is rendered concave by hammer-sinking the lid or bottom of the drum to form a concavity, then laying out and hand forming raised notes on the concave surface of the drum. Handmade pans typically have long delivery times and the high cost associated with hand-crafted objects. Previous attempts at mechanizing the production of steel pans have not been successful in terms of efficiency and producing a high quality musical instrument. Accordingly, a need exists for production techniques that will make this musical instrument more widely available to both students and to professional musicians.

SUMMARY OF THE INVENTION

The present invention provides a process for the production of steel pans which provides consistent, efficient production. The invention also provides a finished instrument with a removable skirt, which facilitates transportation, storage, and tuning of the instrument.

Specifically, the instant invention provides a process for forming a Caribbean steel pan consisting essentially of:

(a) determining the shape and dimensions of a selected Caribbean steel pan or determining an average shape and dimensions of more than one selected Caribbean steel pan;

(b) creating a compilation of topographic data of the shape and dimensions of the pan or pans;

(c) using the resulting compilation to form a mold to substantially replicate the surface of the selected steel pan or pans;

(d) incorporating the mold into a hydroforming press;

(e) pressing a sheet metal disk having a desired diameter and a substantially uniform thickness in the hydroforming press to form a steel pan head having a plurality of individual raised convex note producing shapes formed therein, which produce a resonant sound when struck by a mallet;

(f) heat treating the steel pan head;

(g) trimming the outer edge of the steel pan head; and (h) attaching a side skirt to the pan head to form a Caribbean steel pan.

The present invention further provides the steel pans resulting from this process.

DETAILED DESCRIPTION OF THE INVENTION

Figure 1:
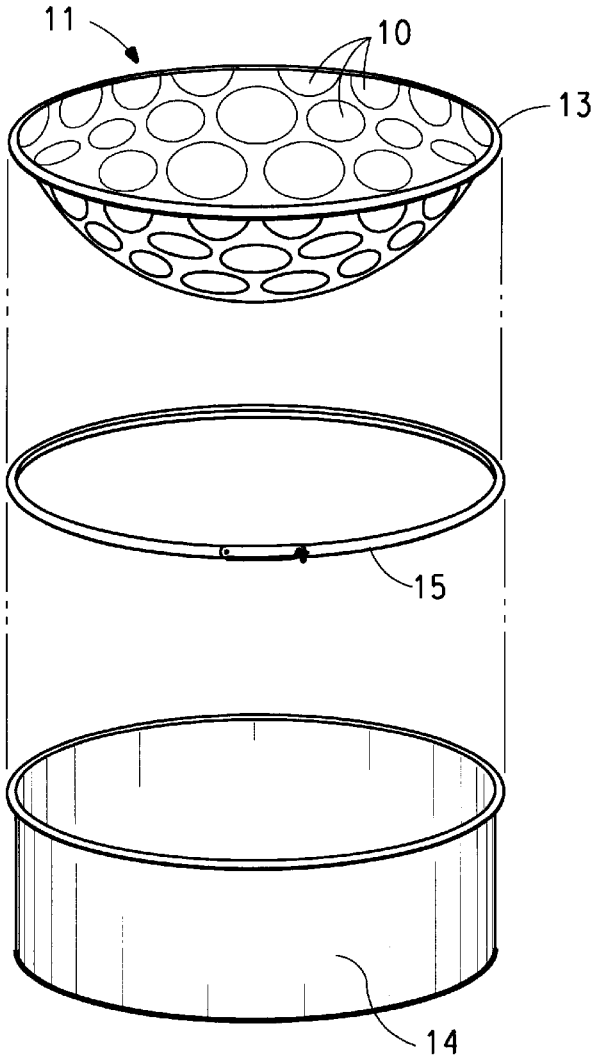
FIG. 1 is an exploded view of a tenor pan of the present invention.

In accordance with the process of the present invention, a Caribbean steel pan is selected for replication based on a variety of performance characteristics, including its timbre. The selected pan should exhibit resonant, clear notes and no dissonant harmonics or overtones. Representative pans include those that are hand-fabricated, typically from an intact 55-gallon oil drum having an 18 gauge carbon steel bottom and a 20 gauge carbon steel side. A smooth finish in the concave field between notes is also a desirable trait in selecting the ideal pan. A typical tenor pan contains 28 to 30 notes covering a musical range of C4 to F6.

The shape and dimensions of the selected pan are first determined. In the alternative, the average shape and dimensions of more than one pan can be determined and the average shape and dimensions used in the instant process. While the shape and dimensions of either the top or bottom of the pan can be used, preferably the playing surface is so determined. The shape and dimensions can be conveniently determined, scanned and digitized using scanning means such as an industrial digitizing probe. The probe can operate by means of any of laser interferometry, a piezo electric transducer, and a variable reluctance probe transducer. Of these, a piezo electric transducer has been found to be particularly satisfactory. The probe typically has a ball-end sensor and the probe is traversed in microstep fashion across the entire surface of the master pan.

The pan is typically scanned and digitized directly. Alternately, a cast male mold of the pan can be made and digitized as described above, if the shape of the pan or the scanning apparatus make this more convenient.

A compilation of topographic data of the shape and dimensions of the pan or pans is created, based on the information previously determined. This compilation can be carried out using available software, such as Bridgeport E-Z Mill or Hermle profiling software, producing a CNC motion-control database. This compilation is then used to form a mold to substantially replicate the surface of the selected steel pan or pans. The resultant digital file is generally post-processed to produce a computer-numerical control (CNC) code. The exact topography of the digitized pan is duplicated by CNC milling of a mild steel plate or other appropriate punch material of diameter and thickness matching the pan inside dimensions.

The CNC milling machine creates the hydro-forming punch with successive cuts by a rotating ball end mill cutting tool. Alternately, other cutting machines or techniques can be used to produce the punch. Standard deburring and finishing operations that follow the milling result in a (male) punch accurate to 0.001 inch or better for the topography of the digitized master pan. The usable work life of the mild steel punch can be, and preferably is, prolonged by cyanide case surface hardening.

The mold so produced is then incorporated into a hydroforming press. A wide variety of hydroforming presses are available. One found to be particularly satisfactory is the Cincinnati Machine Company Hydroform 32 press, a conventional 32-inch hydroforming press.

A sheet metal disk having a desired diameter and a substantially uniform thickness is pressed in the hydroforming press to form a steel pan head conforming to the shape of the steel pan originally replicated. The disc should have a substantially uniform thickness, and can be prepared from steel stock, such as the 18 or 20 gauge drawn-quality cold-rolled steel conventionally used in steel drum manufacture. Other metals which can be used include stainless steels such as 304 alloy stainless steel, 220 alloy bronze, titanium or other sheet stock alloys. Unlike previous carbon steel pans, steel pans made from these less common materials require no electroplating to protect the surface from corrosive oxidation.

The size of the metal disc will vary with the size of the pan to be produced. In general, the disc generally will have a diameter at least about 10 inches greater than the diameter of the pan head being produced. The hydroformed disc has a plurality of individual raised convex note producing shapes formed therein, which produce a resonant sound when struck by a mallet.

The pan head is then heat treated to stabilize the formed configuration. Annealing and stress-relieving of the formed pan in a heat treatment furnace, preferably with a controlled atmosphere, further enhances the uniformity and stability of the pan heads. This specific heat treating operation will necessarily vary with the metal used for the pan head, as will be recognized by those skilled in the art. Typically, carbon steel is blue-annealed for 15 minutes at 570 F.° and 304 alloy stainless steel pans are annealed at 800 F.° for ½ hour to a straw color. Typical annealing temperatures, soak times and quenching methods are shown in Table 1.

TABLE 1

Heat Treatment of Caribbean Steel Pans

| Alloy | Temperature, F.° | Soak Time | Quenching |
|---|---|---|---|
| Cold Rolled Steel | 570, medium blue | 20 minutes | air |
| 304 Stainless Steel | 700, gold straw color | 30 minutes | air |

After annealing, the outer edge of the pan head is trimmed to accommodate attachment of a side skirt. Excess material is trimmed from the rim of each pressed pan by means of a spinning lathe parting tool, laser cutting, plasma arc cutting or by other means to achieve the desired rim diameter.

In preferred embodiments of the process of the present invention, either or both of coarse and fine tuning of the pan follow the step of trimming and rim edge forming. The normal variation of materials and processing conditions generally makes rough tuning necessary. The rough tuning is generally carried out after heat treating or after trimming. Preferably, the rough tuning is carried out after heat treatement and before trimming. Fine tuning is generally carried out after attachment of the skirt, particularly when the skirt is attached permanently. The techniques for both coarse and fine tuning are those conventionally used in the art, as described, for example, in Kronman, "Steel Pan Tuning—A Handbook for Steel Pan Making and Tuning," Musikmuseets, Stockholm, Sweden (1991), hereby incorporated by reference.

The pans produced according to the process of the invention can have a detachable skirt. This embodiment of the invention is preferred, and facilitates transportation, storage and tuning of the pan. It also permits the use of a wide variety of skirts and thus steel pans with variable tones, resonance, and other musical properties, as well as a variable appearance.

The trimmed pan head can be mounted on a Prybill model 40 spinning lathe for edge rolling to either an open head profile for clamping or a closed-head preformed edge for crimping. The lathe faceplate is prepared with the appropriate ANSI National Standard contour for these rim edge configurations.

The shell can be seamed to the pan using a Packaging Specialties custom crimp roller tooling mounted on a modified radial arm drill press. One pan assembly, having a rolled skirt, can be stacked with liquid latex sealing compound applied to the crimp seam of the formed pan head. The radial drill press with a turntable platen forces the shell down onto the contour-formed pan head edge while the crimping rollers close the crimp.

Ferrous steel pans are generally finished by electroplating, typically by sequential copper, nickel and chromium layers. This is followed by hand applications of paste wax. 10% nitric acid will passivate the stainless steel pan surfaces to remove surface oxidation and ferrous deposits from tooling. Electro-chemical polishing of stainless steel and other non-ferrous alloys will produce a fine microline finish. Final tuning or "blending" is preferred after the electroplating, passivation, electropolishing processes or other finishing method.

The invention will be more fully understood by reference to the drawings, in which FIG. 1 is a perspective top view of a showing the one-piece, hydroformed tenor pan with 30 musical notes comprising 2⅙ octaves. The note-producing shapes 10 are raised areas in the upper surface 11 of the pan head. The rim 13 is a standard ANSI steel container dimensional standard rim shape for a rolled edge for a detachable, clamped drum head. Skirt 14 is retained by lever lock clamp ring 15.

Figure 2:
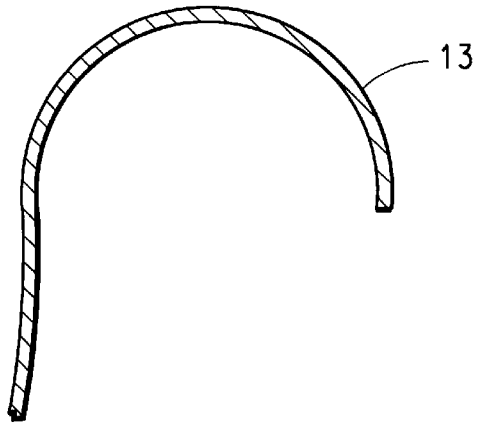
FIG. 2 is a cross-sectional view of a representative rim of a pan of the present invention.

FIG. 2 is a cross-sectional view of a rolled edge shape for removable hydroformed pan attachment to a skirt. In the alternative, a standard ANSI steel container dimensional standard rim shape can be used for a permanent, crimped attachment to a shell.

A radius or an offset is rolled on the rim edge by means of a spinning lathe, sheet metal rolls, secondary press operation or by other means to conform with ANSI standard steel container dimensional standards. A rim edge radius designed for pan head clamping to the shell allows detachment of the playing surface from the drum shell for ease of transport, tuning and exchanging rims of different appearance and resonant qualities. An offset rim edge can be used for permanent attachment of the pan head to the shell.

Pan head clamping of a rolled rim to a rolled shell edge can be achieved by means of a lever-lock band clamp, multiple trunk latches, bolt screw, binding strips or by other means.

A third removable pan head configuration that can be used requires that a rim edge, rolled for rigidity and for safety, is punched with multiple grommet mounting holes for acoustical isolation and for mechanical coupling of threaded studs attached to shell below.

The invention described herein overcomes the variables of hand production and provides a means of manufacturing steel pans characterized by uniform size, shape and thickness of pans produced by said method. The present process, involving hydroforming of the concavity and simultaneously embossing the musical note shapes, assures consistency for controlled, uniform dimensions, resulting in steel pans with predictable tuning characteristics. The hydroforming techniques used in the present invention present marked advantages over those pressing techniques previously attempted using conventional hydraulic presses with matching male and female dies. Those prior techniques resulted in distortion of the note-producing surfaces, making subsequent tuning significantly more difficult or impossible.

The lower cost and rapid production of a hydroformed pan make this instrument more widely available to school and community music programs. The present invention, using hydroforming press technology, permits uniform, low-cost "sinking" of the spherical concavity and simultaneous formation of the convex, musical note-producing shapes. This process can be used to rapidly manufacture the full range and configuration of Caribbean steel pans including the lead tenor, double tenor lead, mid-range "guitar" doubles, cellos and the bass range consisting of 5 or more bass pans having only three or four notes embossed on the playing surface. Diameters can vary widely, depending on the available sizes of hydroforming press, by typically ranging from 10 to 22.5 inches.

The above description shall not be construed as limiting the ways in which this invention may be practiced but shall be inclusive of many other variations that do not depart from the broad interest and intent of the invention.

The present invention will be more fully understood by reference to the following specific example.

EXAMPLE

A 22½" diameter high D lead tenor pan was prepared. A desired hand-made high-D lead tenor pan was first selected for a model, based on its superior tambre, with resonant, clear notes and no dissonant harmonics or overtones. This representative pan was easily fine-tuned, or blended, to octaves and to the $3^{rd}$ harmonic of each note. The pan was hand-fabricated from an intact 55-gallon oil drum composed of an 18 gauge carbon steel bottom and had a 20 gauge carbon steel rim skirt cut 5¾" deep from the original 32" high drum chime. The oil drum had been prepared from cold rolled steel thickness of 1.2 mm or 0.047 inch. The subject pan had a durable, hard chromium-plated surface and a single rim hole on each side for suspending the pan on a playing stand by means of 6" nylon cable ties. The rim was rolled flat (not round beaded) and the skirt is cut off square without rolling or seaming.

The select hand-fabricated D-tenor pan was clamped to the bed of a Hermle model UWF 1000, 3-axis CNC milling machine. A Bridgeport digitizing probe with a ¾" ball end was traversed by power feed at a feed rate of approximately 1½" per minute to determine the shape and dimensions of the pan and create a compilation of topographic data. The programmed step increment used in this digital profiling was 0.005 inch with an overall accuracy of 0.001 inch. The X-Y-Z digital probe positions were post-processed with Hermle software, producing a CNC motion-control database. The resultant machine tool motion from this conversion exactly duplicated the scanned pan topographic detail.

A plate of pre-hardened 4140 mild steel 8" high by 22½" diameter was clamped to the Hermle CNC milling machine bed and milled with a ¾" diameter ball-end mill. This one-week milling process produced an exact 22½" diameter by 8" high male punch of the D-tenor pan.

Square sheets of 20 gauge sheet metal were trimmed to 32½" diameter disks in a Niagra Machine Works model 33RC Disk Shear.

A hydroforming press was set up by first lowering the steel punch by overhead crane and installing it into the lower hydraulic ram chamber of a Cincinnati Machine Company Hydroform 32, a conventional 32" hydroforming press. A cleaned, deburred sheet of sheet steel, cut to a blank size of 32½" diameter as described above, was positioned on the Hydroform Press platen draw ring. A ½" thick, low density polypropylene slip ring, riveted to a ½" thick stainless steel clamp ring was positioned (polymer-side down) on top of the sheet steel blank. The oil-filled flexible die chamber was lowered onto the sheet metal disk and the die chamber is locked into position. Hydraulic pressure was built up in the overhead chamber to preform the blank onto the male punch below. Chamber pressure increased as the male punch was moved upward into the flexible die member. The polymer slip ring allowed the sheet metal disk to slide radially, wrapping it onto the punch. The master depth-setting circle on the operator cam shaft (indicating the punch depth) was stopped at exactly 8.00 inches for the D-tenor pan. The ram motion was reversed, lowering the male punch as the upper, flexible die chamber was raised up off the finished part. This action strips the punch from the finished part; a hydroformed Caribbean pan head.

Hydroforming produced details of the raised, convex playing notes on the concave, spherical pan head by means of the continuous controlled punch forming pressure and by the simultaneous wrapping action from the flexible die chamber diaphragm.

The hydroformed pan head was then annealed and stress-relieved in a Recco model 448 Solution/Heat Treatment Furnace. The Recco furnace temperature chart recorder showed the furnace temperature profile to assure the correct soak time and temperature.

Each pan note fundamental tone and harmonics was rough tuned using 12, 24 and 32 oz. ball peen hammers. This process required less time than for conventional pan tuning since a skirt or drum rim did not interfere with hammering from the underside, an appreciable benefit in softening and tuning the lower notes along the rim.

After rough tuning, the surplus flange material on the hydroformed pan head was template-scribed to 24⅜" diameter and sheared off with a Bosch model 1500 throatless power shear.

A skirt was prepared and attached to the pan head. Vinyl-masked mirror-finish 304 stainless steel (No. 2 Special Bright Annealed, Republic Steel Company) 20 gauge sheet stock was sheared in a Wysong 796 model #P6-121 pneumatic-operated power shear to produce a 6" high skirt. It was subsequently roll-formed on a Whitney Roll Forming machine and the seam was butt welded by a Pandjiris 72E exterior seamer.

The resulting pan head, with skirt attached, was then finished. The skirt weld tarnish was chemically cleaned with an Ox-Out Power Pak model 536 by ChemClean Corp. Additional finishing is not required for the No. 2 Special Bright Annealed, 20 gauge, 304 stainless steel alloy sheet stock, produced with a mirror finish by Republic Steel Corporation.

The resulting pan was tested, and found to have excellent musical characteristics.

We claim:

1. A process for forming a Caribbean steel pan consisting essentially of:

(a) determining the shape and dimensions of a selected Caribbean steel pan or determining an average shape and dimensions of more than one selected Caribbean steel pan;

(b) creating a compilation of topographic data of the shape and dimensions of the pan or pans;

(c) using the resulting compilation to form a mold to substantially replicate the shape and dimensions of a single pan or the average shape and dimensions of more than one selected Caribbean steel pan;

(d) incorporating the mold into a hydroforming press;

(e) pressing a sheet metal disk having a desired diameter and a substantially uniform thickness in the hydroforming press to form a steel pan head having a plurality of individual raised convex note producing shapes formed therein, which produce a resonant sound when struck by a mallet;

(f) heat treating the steel pan head;

(g) trimming the outer edge of the steel pan head; and (h) attaching a side skirt to the pan head to form a Caribbean steel pan.

2. A process of claim 1 wherein the steel pan head is rough tuned after heat treatment.

3. A process of claim 2 wherein the steel pan head is fine tuned after a skirt has been attached.

4. A process of claim 1 wherein the steel pan head is rough tuned after heat treatment and fine tuned after a skirt has been attached.

5. A process of claim 1 wherein the shape and dimensions of the steel pan are determined by at least one means selected from the group consisting of laser interferometry, a piezo electric transducer, and a variable reluctance probe transducer.

6. A process of claim 5 wherein the shape and dimensions of the steel pan are determined by a piezo electric transducer.

7. A process of claim 5 wherein the shape and dimensions of the top or playing surface of the steel pan are determined.

8. A process of claim 1 wherein a male mold is formed.

9. A process of claim 1 wherein the side skirt is attached to the pan head by welding.

10. A process of claim 1 wherein the side skirt is attached to the pan head by clamping.

11. A process of claim 10 wherein the skirt is detachable from the pan head.

12. A process of claim 1 wherein the metal disc consists essentially of steel.

13. A process of claim 1 wherein the metal disc is prepared from metal selected from the group consisting of bronze, aluminum, titanium and stainless steel alloys.

* * * * *

US006212772C1

(12) EX PARTE REEXAMINATION CERTIFICATE (6477th)

United States Patent

Whitmyre et al.

(10) Number: US 6,212,772 C1

(45) Certificate Issued: Oct. 14, 2008

(54) PRODUCTION OF A CARIBBEAN STEEL PAN

(75) Inventors: George Whitmyre, Elkton, MD (US); Harvey J. Price, Wilmington, DE (US)

(73) Assignee: Hydrosteel, LLC, Wilmington, DE (US)

Reexamination Request:
No. 90/008,487, Feb. 15, 2007

Reexamination Certificate for:

| | |
|---|---|
| Patent No.: | **6,212,772** |
| Issued: | **Apr. 10, 2001** |
| Appl. No.: | **09/338,058** |
| Filed: | **Jun. 23, 1999** |

(51) Int. Cl.
*G10D 13/02* (2006.01)

(52) U.S. Cl. ..... 29/896.22; 84/411 R

(58) Field of Classification Search ..... 72/55, 72/58–63

See application file for complete search history.

(56) References Cited

U.S. PATENT DOCUMENTS 3,672,194 A * 6/1972 Martin ..... 72/55

OTHER PUBLICATIONS

Blake, F. I. R., The Trinidad & Tobago Steel Pan: History and Evolution. 1995, pp. 102–103, United Kingdom.

Dennis, R.A., A Preliminary Investigation of the Manufacture and Performance of a Tenor Steel Pan, W. Indies Jnl. of Eng'g, 3:1, Apr. 1971, pp. 48 & 52, Trinidad, W. I.

Farago, F. & Curtis M., Handbook of Dimensional Measurements, 1994, p. 329, USA.

Ferreyra, E., et al., Materials Science and Metallurgy of the Caribbean Steel drum, part II, Jnl. of Materials Science 34, Mar. 1999, pp. 981–984, USA.

Imbert, C., Investigation of Commercial Production Techniques of Steelpan Instruments, Caribbean Industrial Research Institute, 1977, pp. 4–5, 7–9, 12–13, & 32, Trinidad, W. I.

Imbert, C., et al., Mechanising the Manufacture of Steel–Pan Musical Instruments, Apett Jnl., 27, 1993, p. 39, Trinidad, W. I.

Imbert, C. et al., The Technology of the Steelpan as a Musical Instrument, 1994, pp. 3, 6, & 17, Trinidad, W. I.

Kronman, ULF, Steel Pan Tuning, 1992, pp. 40–44 & 70, Sweden.

McDavid, Maynard & LeBlanc, Report on Investigation of Steelpan Manufacturer, Caribbean Industrial Research Institute, 1984, p. 13, Trinidad, W. I.

Murr, L. E. et al., Materials Science and Metallurgy of the Caribbean Steel Drum, Part I, Jnl. of Materials Sci. 34, Mar. 1999, p. 969, USA.

Seeger, P., Steel Drums: How to Play Them and Make Them, 1964, pp. 4 & 21, USA.

Sirohi, R. & Kothiyal, M., Optical Components, Systems and Measurement Techniques, 1991, pp. 160–162, USA.

Trietley, Harry L., Transducers in Mechanical and Electronic Design, 1996, pp. 11, 67–69, 86, & 133, USA.

Wilson, Salah A., Steelpan Playing with Theory, 1999, p. 2, Canada.

Standards for Steel Drums, 49 C.F.R. § 178.504 (b) (2), 1998, USA.

* cited by examiner

*Primary Examiner*—Catherine Serke Williams

(57) ABSTRACT

Process for the formation of a Caribbean steel pan using a hydroforming press and the resulting pans.

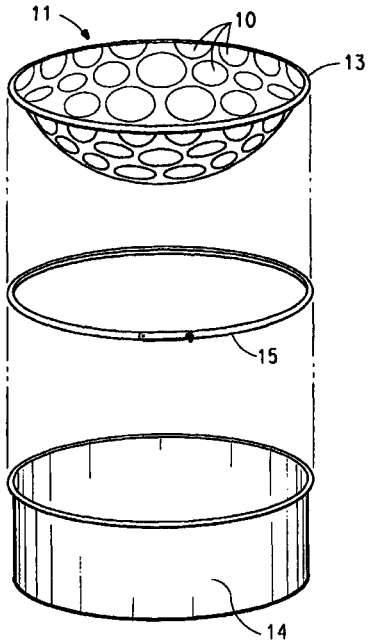

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–13 is confirmed.

* * * * *